US010257620B2

(12) United States Patent
Durrieu

(10) Patent No.: US 10,257,620 B2
(45) Date of Patent: Apr. 9, 2019

(54) METHOD FOR DETECTING TONAL SIGNALS, A METHOD FOR OPERATING A HEARING DEVICE BASED ON DETECTING TONAL SIGNALS AND A HEARING DEVICE WITH A FEEDBACK CANCELLER USING A TONAL SIGNAL DETECTOR

(71) Applicant: SONOVA AG, Staefa (CH)

(72) Inventor: Jean-Louis Durrieu, Auenstein AG (CH)

(73) Assignee: Sonova AG, Staefa (CH)

( * ) Notice: Subject to any disclaimer, the term of this patent is extended or adjusted under 35 U.S.C. 154(b) by 459 days.

(21) Appl. No.: 15/200,113

(22) Filed: Jul. 1, 2016

(65) Prior Publication Data

US 2018/0007476 A1 Jan. 4, 2018

(51) Int. Cl.
*H04R 25/00* (2006.01)

(52) U.S. Cl.
CPC ..... *H04R 25/453* (2013.01); *H04R 25/353* (2013.01); *H04R 2430/03* (2013.01)

(58) Field of Classification Search
CPC . H04R 25/453; H04R 25/353; H04R 2430/03
USPC ..... 381/318
See application file for complete search history.

(56) References Cited

U.S. PATENT DOCUMENTS 6,130,949 A * 10/2000 Aoki ..... G10H 3/125 381/94.3
6,674,865 B1 * 1/2004 Venkatesh ..... H04M 9/082 381/107
6,856,653 B1 * 2/2005 Taniguchi ..... H03H 17/0266 375/285
2003/0169892 A1 * 9/2003 Ura ..... H04R 3/02 381/93
2005/0141737 A1 * 6/2005 Hansen ..... G10L 21/0208 381/316

(Continued)

*Primary Examiner* — Davetta W Goins
*Assistant Examiner* — Phylesha Dabney
(74) *Attorney, Agent, or Firm* — ALG Intellectual Property, LLC

(57) ABSTRACT

The present invention proposes a method for providing at least one indication regarding whether an input signal contains a tonal signal component. The proposed method comprises decomposing the input signal into a plurality of band-limited input signals and then for each of one or more of the plurality of band-limited input signals performing the following step: estimating parameters of a parametric tonal signal model adapted to model and predict a tonal-only signal component of a selected one of the one or more of the plurality of band-limited input signals; synthesizing based on the estimated parameters a corresponding predicted band-limited input signal; and determining a measure of mismatch between the selected band-limited input signal and the corresponding predicted band-limited input signal. Subsequently, the at least one indication is provided based on the measure of mismatch determined for at least one of the one or more of the plurality of band-limited input signals. Furthermore, a method for operating a hearing device is proposed, which employs such a method for detecting tonal signals, and a hearing device with a feedback canceller is presented, which relies on a tonal signal detector in order to improve feedback cancelling.

10 Claims, 3 Drawing Sheets

(56) References Cited

U.S. PATENT DOCUMENTS

2009/0028367 A1* 1/2009 Klinkby ..... H04R 25/453
381/318
2013/0142349 A1* 6/2013 Liu ..... G10K 11/002
381/71.11

* cited by examiner

METHOD FOR DETECTING TONAL SIGNALS, A METHOD FOR OPERATING A HEARING DEVICE BASED ON DETECTING TONAL SIGNALS AND A HEARING DEVICE WITH A FEEDBACK CANCELLER USING A TONAL SIGNAL DETECTOR

TECHNICAL FIELD

The present invention pertains to a method for detecting tonal signals. Furthermore, a method for operating a hearing device is proposed, which employs such a method for detecting tonal signals. More specifically, a hearing device with a feedback canceller is presented, which relies on a tonal signal detector according to the present invention in order to improve feedback cancelling performance.

BACKGROUND OF THE INVENTION

Audio signals typically comprise a combination of noise- and sinusoid-like signals. A distinction between sinusoids and noise is particularly relevant when processing speech signals, where the sinusoids define the "pitch" of the speaker, while the noisy components reflect the consonants in the speech signals. For these reasons, it is very interesting to be able to distinguish between these two signal categories in the context of a sound processor, and in particular in hearing devices, whose main goal is to enhance speech signals and intelligibility. Furthermore, many other applications can benefit from the ability to separately process sinusoids and noise, if a reliable means is provided to identify the presence of tonal signals, i.e. of sinusoidal components. Hence, there exists a need for improved means for reliably and easily detecting tonal signals.

SUMMARY OF THE INVENTION

In a first aspect, it is therefore an object of the present invention to provide an improved method for detecting tonal signals, capable of reliably determining whether an input signal contains a tonal signal component, whereby the method should have a computational complexity that can be handled by battery powered miniature hearing devices intended to be worn at an ear of a user and to be operated for a prolonged period of time. This object is achieved by the method according to claim 1.

Moreover, in a second aspect, it is a further goal of the present invention to provide an improved method for operating a hearing device by making use of the proposed method for detecting tonal signals. This aim is achieved by the method according to claim 6.

Furthermore, in a third aspect, it is yet another goal of the present invention to provide a hearing device with a feedback canceller, which relies on a tonal signal detector for detecting tonal signals in order to improve feedback cancelling performance. This aim is achieved by the hearing device according to claim 10.

Specific embodiments of the methods according to the present invention are given in the dependent claims.

According to the first aspect of the present invention, a method is proposed for providing at least one indication regarding whether an input signal contains a tonal signal component, the method comprising the steps of:

decomposing the input signal into a plurality of band-limited input signals, in particular by means of an analysis filter bank, e.g. employing a fast Fourier transform (FFT), said decomposing providing a time-frequency domain representation of the input signal;

for each of one or more, preferably for all, of the plurality of band-limited input signals:

estimating parameters of a parametric tonal signal model adapted to model and predict a tonal-only signal component in a selected one of the one or more of the plurality of band-limited input signals;

synthesizing based on the estimated parameters a corresponding predicted band-limited input signal; and determining a measure of mismatch between the selected band-limited input signal and the corresponding predicted band-limited input signal;

and providing the at least one indication based on the measure of mismatch determined for at least one of the one or more of the plurality of band-limited input signals.

It should be noted that the term "band-limited" is not to be understood in a strict sense, i.e. as meaning that a signal is strictly confined to a limited frequency range, but is intended to be a designator for a signal whose frequency content is mainly (e.g. 90% thereof) concentrated within a limited frequency range, and should therefore imply that the signal is "essentially band-limited". This is how the skilled person would understand the term in the context of real world signals, where limited frame length temporal signals are transformed into the frequency domain, e.g. by means of an FFT, resulting in a plurality of "band-limited" signals, where the frequency range of an individual frequency domain signal centered in a certain channel will in fact extend into neighboring channels. It is well-known that the extent of frequency overlap can be controlled in a desired manner by employing appropriate windowing.

In an embodiment of the method the parametric tonal signal model is adapted to model and predict the tonal-only signal component consisting of a predefined number of sinusoids, in particular consisting of I=1 to 4 sinusoids.

In a further embodiment of the method the parameters of the parametric tonal signal model are estimated by means of linear prediction coefficients constrained such that a one-to-one relationship, i.e. a bijection, exists between the parameters of the parametric tonal signal model and the linear prediction coefficients, the linear prediction coefficients in particular being determined by means of an adaptive filter estimation scheme, such as a gradient descent scheme, for instance by means of a recursive least squares (RLS), least mean squares (LMS) or normalized LMS (NLMS) technique constrained such that said one-to-one relationship exists between said parameters of said parametric tonal signal model and said linear prediction coefficients.

In a further embodiment of the method the linear prediction coefficients $\hat{B}_1, \ldots, \hat{B}_I$ are constrained as follows:

$$\text{for } I = 1\text{: } |\hat{B}_1| = 1;$$

$$\text{for } I = 2\text{: } |\hat{B}_1| \le 2 \text{ and } \hat{B}_2 = -\frac{\hat{B}_1^2}{|\hat{B}_1|^2};$$

$$\text{for } I = 3\text{: } |\hat{B}_1| \le 3, |\hat{B}_2| \le 3 \text{ and } \hat{B}_3 = -\frac{\hat{B}_1\hat{B}_2}{|\hat{B}_1\hat{B}_2|};$$

$$\text{for } I = 4\text{: } |\hat{B}_1| \le 4, |\hat{B}_2| \le 6, \hat{B}_4 = -\frac{\hat{B}_2^2}{|\hat{B}_2|^2} \text{ and } \hat{B}_3 = -\hat{B}_1^*\hat{B}_4,$$

wherein I is the predefined number of sinusoids of the parametric tonal signal model.

In a further embodiment of the method the measure of mismatch is given by an error-to-signal energy ratio (i.e. an "inverse SNR"), such as a ratio of a squared magnitude of a difference between the selected band-limited input signal and the corresponding predicted band-limited input signal and a squared magnitude of the selected band-limited input signal, wherein in particular the measure is in the range from 0 to 1, wherein 0 indicates that the band-limited input signal contains a tonal component, and 1 indicates that the band-limited input signal does not contain a tonal component, and a value between 0 and 1 indicates a likelihood that the band-limited input signal does not contain a tonal component.

In a further embodiment of the method said indication is based on a decision accumulator $p_m(k)$ according to the following equation:

$$p_m(k) = \begin{cases} \min(p_{m-1}(k) + \delta_+, 1), & \text{if } \tilde{r}_m(k) < \epsilon_r \\ \max(p_{m-1}(k) - \delta_-, 0), & \text{otherwise} \end{cases},$$

wherein m is a time or frame index, $\tilde{r}_m(k)$ is a time-averaged measure of mismatch for the k-th frequency channel (e.g. $\tilde{r}_m(k)=(\Sigma_{i=0}^{L-1}P_{m-i}(k))/L$ with $P_m(k)$ being the current measure of mismatch and L being the number of frames over which averaging takes place), $\epsilon_r$ is a predetermined threshold value, and $\delta_+$ and $\delta_-$ are increment and decrement step size values. $\delta_-$ can for instance be set in such a way that the end of sinusoidal detection leads to a reset for the value $p_m(k)$, e.g. by setting $\delta_-=1$. We then see the following behavior for $p_m(k)$ from the above equation. When the input signal does not contain a tonal component $\tilde{r}_m(k)$ is larger than the predetermined threshold value $\epsilon_r$, and therefore $p_m(k)=0$. Once a tonal signal is present in the input signal $\tilde{r}_m(k)$ decreases until it drops below the predetermined threshold value $\epsilon_r$, and therefore $p_m(k)$ increases until it saturates at $p_m(k)=1$.

According to the second aspect of the present invention, a method is proposed for operating a hearing device, in particular a hearing aid to be worn at an ear of a user, comprising the steps of:

- receiving an input audio signal;
- providing at least one indication regarding whether the input audio signal contains a tonal signal component according to the method proposed under the first aspect of the present invention;
- applying at least one of the following signal processing schemes to the input audio signal:
  - feedback cancelling;
  - noise cancelling;
  - frequency transposition or frequency compression;
  - frequency and/or input level dependent amplification according to a gain model;
  - sound classification;
  - beamforming;
  - occlusion cancelling,
- dependent on the at least one indication to provide a processed audio signal and/or identify at least one sound class representative of the input audio signal; and
- outputting an output audio signal based on the processed audio signal and/or in dependence of the at least one sound class.

In an embodiment of the method at least one of the signal processing schemes is applied to one or more of the plurality of band-limited input audio signals.

In a further embodiment of the method feedback cancelling is applied to one or more of the plurality of band-limited input audio signals and comprises the following steps for each of said one or more of the plurality of band-limited input audio signals:

- subtracting the predicted band-limited input audio signal from the band-limited input audio signal to produce a first modified band-limited input audio signal;
- synthesizing based on the same estimated parameters as used to synthesize the predicted band-limited input audio signal a predicted band-limited processed audio signal;
- subtracting the predicted band-limited processed signal from the corresponding band-limited processed audio signal to produce a modified band-limited processed audio signal;
- determining filter coefficients of a feedback estimation filter based on the modified band-limited processed audio signal and/or on the band-limited processed audio signal dependent on the at least one indication, and further based on the first modified band-limited input audio signal and/or the band-limited input audio signal dependent on the at least one indication;
- applying the band-limited processed audio signal to the feedback estimation filter to produce an estimated band-limited feedback signal;
- subtracting the estimated band-limited feedback signal from the band-limited input signal to produce a second modified band-limited input signal.

In a further embodiment the method further comprises the step of:

- applying the second modified band-limited input signal to a frequency and/or input level dependent amplification according to a gain model to produce the band-limited processed audio signal.

In a further embodiment of the method feedback cancelling further comprises the steps of:

- generating a noise signal; and
- adding the noise signal to the band-limited processed signal, in dependence of the at least one indication, wherein in particular no noise signal is generated if the decision accumulator $p_m(k)$ is below a first pre-set threshold.

In a further embodiment of the method the level of the noise signal is dependent on the level of the second modified band-limited input signal.

In a further embodiment of the method a frequency range of the noise signal is limited dependent on a frequency range of the band-limited input audio signal.

In a further embodiment of the method determining the filter coefficients of the feedback estimation filter is based on the modified band-limited processed audio signal weighted by a first weight factor $w_1$, the band-limited processed audio signal weighted by a second weight factor $w_2$, the first modified band-limited input audio signal weighted by a third weight factor $w_3$, and the band-limited input audio signal weighted by a fourth weight factor $w_4$, the weight factors $w_1$, $w_2$, $w_3$ and $w_4$ being dependent on the at least one indication, wherein for instance the weight factors are in the range from 0 to 1, and wherein for instance $w_2=1-w_1$ and $w_4=1-w_3$, in particular wherein $w_1=1$, $w_2=0$, $w_3=1$ and $w_4=0$ if the decision accumulator $p_m(k)$ is above a second pre-set threshold, and wherein $w_1=0$, $w_2=1$, $w_3=0$ and $w_4=1$ if the decision accumulator $P_m(k)$ is below the second pre-set threshold, wherein in particular the first and the second pre-set threshold are the same. The weighting factors may for instance also be chosen to be pair-wise identical, i.e. $w_1=w_3$ and $w_2=w_4$.

According to the third aspect of the present invention, a hearing device is proposed comprising:

- an input transducer structured and configured to receive an input audio signal;
- a signal processing unit structured and configured to process the input audio signal and to produce a processed audio signal; and
- an output transducer structured and configured to output an output audio signal based on the processed audio signal, wherein the signal processing unit comprises:

- an analysis filter bank structured and configured to decompose the input audio signal into a plurality of band-limited input audio signals;
- an amplification unit structured and configured to apply a frequency and/or input level dependent amplification according to a gain model to the plurality of band-limited input audio signals to produce a plurality of band-limited processed audio signals;
- an synthesis filter bank structured and configured to combine or compose the plurality of band-limited processed audio signals into the processed audio signal;
- a feedback canceller; and
- a tonal signal detector operationally connected to the feedback canceller, wherein the tonal signal detector comprises a tonal signal prediction filter with an input, to which a selected one of the band-limited input audio signal is provided, and an output providing a predicted band-limited input audio signal, the tonal signal detector being further structured and configured to determine a measure of mismatch between the band-limited input audio signal and the predicted band-limited input audio signal, and wherein the feedback canceller comprises:

- a further filter for applying the same filter coefficients as the tonal signal prediction filter to produce a predicted band-limited processed audio signal;
- a computation unit configured to determine further filter coefficients based on a difference between the band-limited processed audio signal and the predicted band-limited processed audio signal and/or on the band-limited processed audio signal dependent on the measure of mismatch, and further based on a difference between the input audio signal and the predicted input signal and/or on the band-limited input audio signal dependent on the measure of mismatch;
- a feedback estimation filter operationally connected to the computation unit and adapted to filter with the further filter coefficients the band-limited processed audio signal to provide an estimated band-limited feedback signal, and wherein an input of the amplification unit is connected to an output of a subtraction unit adapted to subtract the estimated band-limited feedback signal from the band-limited input audio signal.

In an embodiment the hearing device further comprises a noise generator structured and configured to generate a noise signal at its output in dependence of the measure of mismatch, wherein the output of the noise generator and the output of the amplification unit are connected with the inputs of an adder, the output of which provides the processed audio signal, wherein in particular no noise signal is generated if the decision accumulator $p_m(k)$ is below a first pre-set threshold.

In a further embodiment of the hearing device the computation unit is configured to determine the filter coefficients of the feedback estimation filter based on weighting the difference between the band-limited processed audio signal and the predicted band-limited processed audio signal with a first weighting factor $w_1$, weighting the band-limited processed audio signal with a second weighting factor $w_2$, weighting difference between the input audio signal and the predicted input signal with a third weighting factor $w_3$, and weighting the band-limited input audio signal with a fourth weighting factor $w_4$, the weight factors $w_1$, $w_2$, $w_3$ and $w_4$ being dependent on said measure of mismatch, wherein for instance the weight factors are in the range from 0 to 1, and wherein for instance $w_2=1-w_1$ and $w_4=1-w_3$, in particular wherein $w_1=1$, $w_2=0$, $w_3=1$ and $w_4=0$ if a decision accumulator $p_m(k)$ derived from said measure of mismatch is above a second pre-set threshold, and wherein $w_1=0$, $w_2=1$, $w_3=0$ and $w_4=1$ if the decision accumulator $p_m(k)$ is below the second pre-set threshold. The weighting factors may for instance also be chosen to be pair-wise identical, i.e. $w_1=w_3$ and $w_2=w_4$.

In is specifically pointed out that combinations of the embodiments described above can result in even further more specific embodiments.

BRIEF DESCRIPTION OF THE DRAWINGS

The present invention is further explained below by means of non-limiting specific embodiments and with reference to the accompanying drawings showing the following.

DETAILED DESCRIPTION OF THE INVENTION

Figure 1:
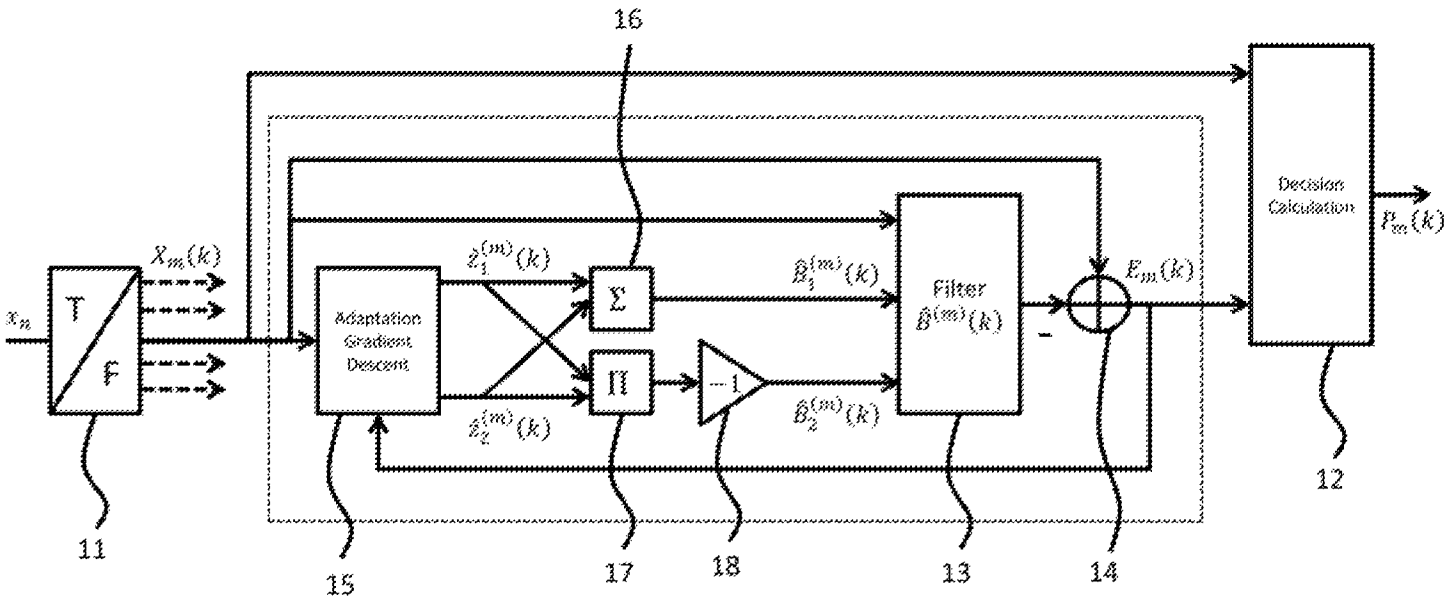
FIG. 1 depicts a block diagram of a first embodiment of a tonal signal detector adapted to perform the method according to the present invention for providing at least one indication regarding whether an input signal contains a tonal signal component.

In order to illustrate the proposed method for providing at least one indication regarding whether an input signal contains a tonal signal component the exemplary case where I=2 sinusoids are estimated within a band-limited frequency channel k is explained in the following. k is one of the frequency channels/bands provided by decomposing the input signal into a plurality of band-limited input signals, e.g. by means of an analysis filter bank. Two alternative implementations are described in order to demonstrate how different constraints can be applied such that a one-to-one relationship is achieved between the parameters of the parametric tonal signal model and the linear prediction coefficients.

For both implementations the following generic scheme is applied (cf. FIGS. 1 & 2):

1. Acquire a time domain microphone signal $x_n$;

2. Analyze it using an analysis filter bank 11, 21, resulting in a plurality of time-frequency signals $X_m(k)$, where m is the frame number and k is the frequency channel number;
3. For each frequency channel k, compute the prediction error signal $E_m(k)$ using the previous estimates of the predictive filter coefficients $\hat{B}_1^{(m-1)}(k)$ and $\hat{B}_2^{(m-1)}(k)$ (cf. filter 13 and adder 14; 23 and 24): $E_m(k)=X_m(k)-(\hat{B}_1^{(m-1)}(k)X_{m-1}(k)+\hat{B}_2^{(m-1)})X_{m-2}(k))$;
4. Update the estimates of the predictive filter coefficients $\hat{B}_1^{(m)}(k)$ and $\hat{B}_2^{(m)}(k)$ using either one of the implementations A or B detailed below;
5. Compute the ratio between the energy of $E_m(k)$ and the energy of $X_m(k)$, and determine the probability of a tonal signal being present as provided by the detector output signal $P_m(k)$ (cf. decision calculation block 12, 22).

The time-frequency signals $X_m(k)$ is understood to be essentially band-limited to the k-th frequency channel. The term "time-frequency" is used to denote that the signal $X_m(k)$ is related to the m-th time frame of the signal transformed into the k-th frequency channel.

In channel k there are two sinusoids at respective frequencies $f_1$ and $f_2$. Let M be the step-size of the time-frequency analysis, and let $z_i=\exp(2j\pi f_i M)$, i=1, 2. In this case, the time-frequency signal $X_m(k)$ is predictable, and follows the recurrent equation:

$$X_{m+2}(k)=B_1(k)X_{m+1}(k)+B_2(k)X_m(k)=(z_1+z_2)X_{m+1}(k)-z_1z_2X_m(k).$$

The presented implementations use the above relation to estimate and predict the signal. Now the two alternative implementations A and B are individually described in detail.

According to the implementation A as shown in the block diagram in FIG. 1, the sinusoidal model parameters are estimated directly using a gradient descent approach (cf. adaptation block 15), and then the corresponding predictive coefficients are determined as follows:

a) Using the previous estimates of the model parameters $\hat{z}_1^{(m-1)}(k)$ and $\hat{z}_2^{(m-1)}(k)$ and the delayed input signal $X_{m-1}(k)$ and $X_{m-2}(k)$, compute the gradients $\delta E_1$ and $\delta E_2$;
b) Update $\hat{z}_1^{(m)}(k)$ and $\hat{z}_2^{(m)}(k)$ using these gradients and the error signal $E_m(k)$ under the constraint that $|\hat{z}_i^{(m)}(k)|=1$, i=1, 2;
c) Compute the predictive filter coefficients such that:
   i. $\hat{B}_1^{(m)}(k)=\hat{z}_1^{(m)}(k)+\hat{z}_2^{(m)}(k)$ (cf. adder 16),
   ii. $\hat{B}_2^{(m)}(k)=\hat{z}_1^{(m)}(k)\hat{z}_2^{(m)}(k)$ (cf. multiplier 17 and inverter 18).

Figure 2:
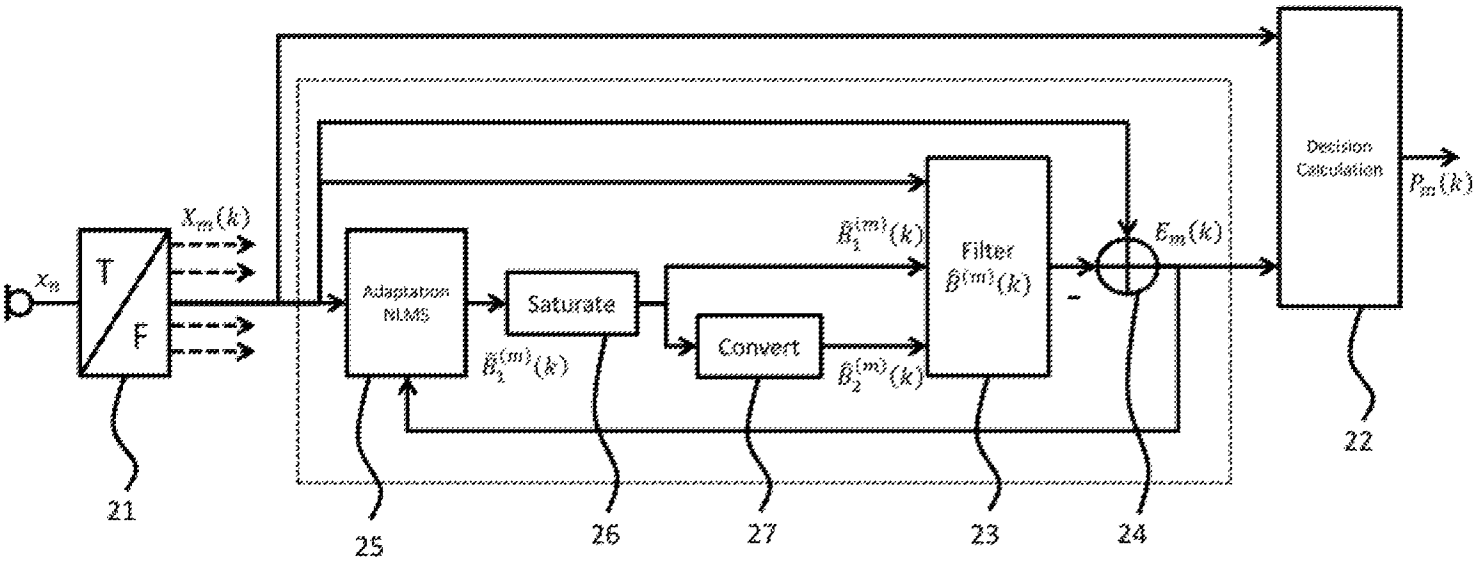
FIG. 2 depicts a block diagram of a second embodiment of a tonal signal detector adapted to perform the method according to the present invention for providing at least one indication regarding whether an input signal contains a tonal signal component.

Alternatively, according to the implementation B as shown in the block diagram in FIG. 2, one of the predictive coefficient is estimated using the normalized least mean squares (NLMS) algorithm (cf. adaptation block 25), which is usually simpler than the gradient approach. This first coefficient is then saturated (first constraint) and the second coefficient can be determined from the resulting coefficient as follows (second constraint):

a) Update the predictive coefficient $\hat{B}_1^{(m-1)}(k)$ using the error signal $E_m(k)$ to obtain a coefficient $\tilde{B}_1^{(m)}(k)$ (cf. adaptation block 25);
b) Saturate $\tilde{B}^{(m)}(k)$ such that it has a maximum magnitude of 2 to obtain $\hat{B}_1^{(m)}(k)$ (cf. saturation block 26);
c) Compute $$\hat{B}_2^{(m)}(k) = -\left(\frac{\hat{B}_1^{(m)}(k)}{|\hat{B}_1^{(m)}(k)|}\right)^2$$

(cf. computation block 27).

Since tonal signal detection can be performed in each frequency channel k separately, the number of sinusoids that can be detected depends on the total number of frequency channels (i.e. the plurality K of band-limited input audio signals being analyzed).

In several blocks within in a hearing device it is of interest to be able to act differently depending whether the input is "voiced" (i.e. periodic or sinusoid-like) or "unvoiced" (i.e. noise-like). For instance, the noise canceller should attenuate low-intensity background noise, and hence enhance low-intensity sinusoids. Furthermore, in the feedback canceller sinusoids are signals whose auto-correlation is very strong, resulting in the feedback canceller reacting "chaotically". It is therefore desirable to detect such input signals and take action accordingly. A listening situation classifier can use such a feature to enhance its accuracy, and the predictability of the sinusoids can also be advantageously used for active cancellation of the direct path.

In the following we describe an exemplary implementation of a hearing device with a feedback canceller, which employs a tonal signal detector according to the present invention in order to improve feedback cancelling performance.

Figure 3:
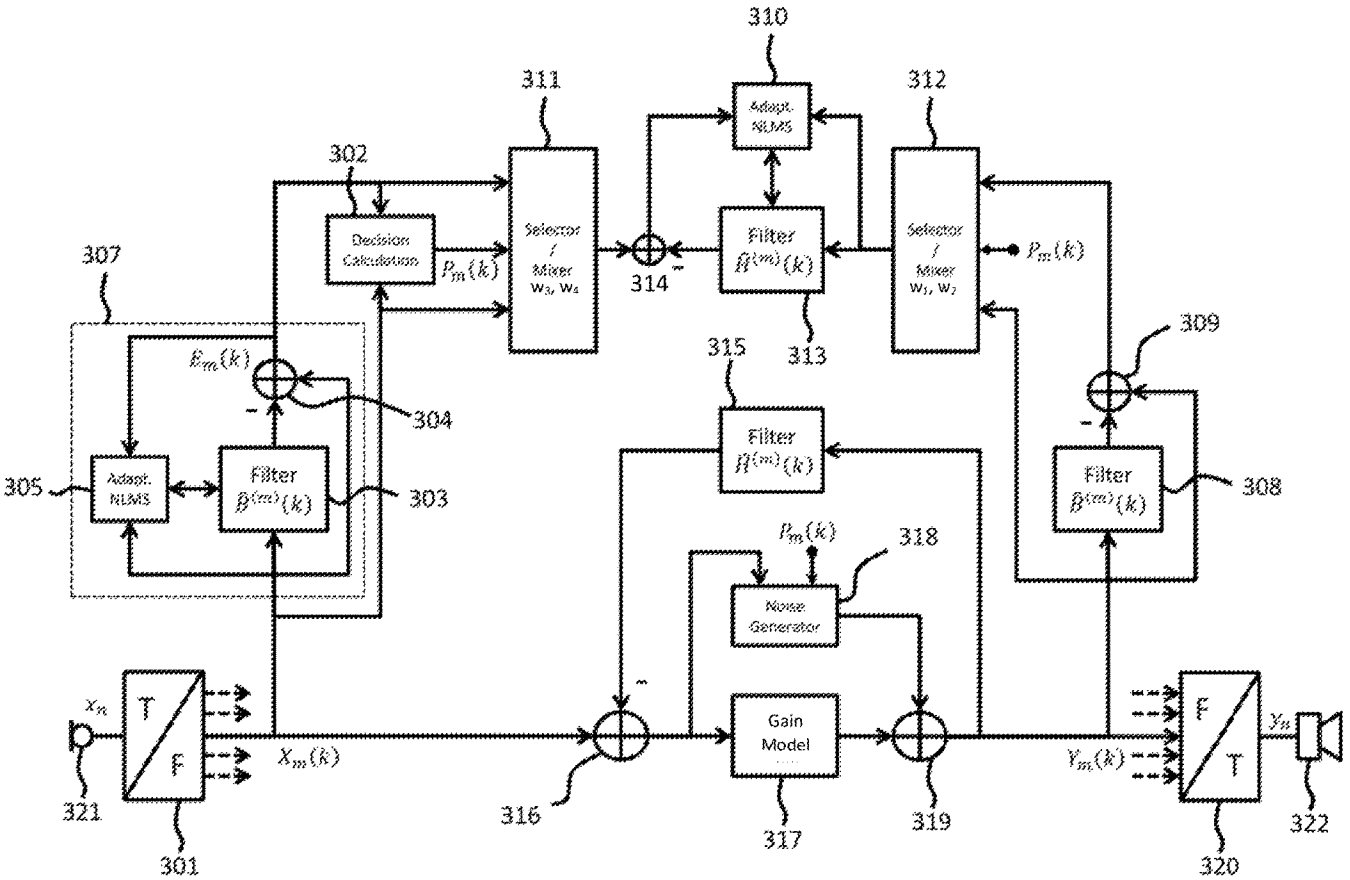
FIG. 3 depicts a block diagram of a hearing device with a feedback canceller and a tonal signal detector according to the present invention.

The block diagram of an exemplary embodiment of the proposed hearing device is depicted in FIG. 3. First the time domain input audio signal $x_n$ from a microphone 321 or another input source (such as for instance a T-coil or wireless receiver for receiving a transmitted audio signal) is passed through an analysis filter bank 301 where the input audio signal $x_n$ is decomposed into a plurality K of time-frequency input signals $X_m(k)$, where m is the frame number and k is the frequency channel number. The analysis filter bank 301 thus splits the input audio signal $x_n$ into a plurality of signals each essentially band-limited to a specific frequency channel. Subsequently, each time-frequency input signal $X_m(k)$ may be further processed individually. Typically, all K signals are processed, but feedback cancelling may only be applied to a selected subset of these signals. What is shown in the block diagram in FIG. 3 is the processing performed for one of the plurality of time-frequency input signals $X_m(k)$. The other K−1 time-frequency input signals $X_m(k)$ may be processed in essentially the same manner. The core idea of the proposed feedback cancelling scheme according to the present invention is to adapt the feedback estimation filter $\hat{H}^{(m)}(k)$ 313 differently depending on whether a tonal signal component is present in the time-frequency input signal $X_m(k)$. In particular, it is the aim to remove a tonal signal from the time-frequency input signal $X_m(k)$ if a tonal signal detector (cf. 307 with 302) determines that a tonal signal component is present in the time-frequency input signal $X_m(k)$.

The tonal signal detector 307 with 302 is structured according to the block diagram of FIG. 1 or 2 and determines the predictive filter coefficients $\hat{B}_1^{(m)}(k)$, $\hat{B}_2^{(m)}(k)$ of the tonal signal prediction filter $\hat{B}^{(m)}(k)$ 303 as well as the measure of mismatch $P_m(k)$, which provides an indication regarding whether the time-frequency input signal $X_m(k)$ contains a tonal signal component. Alternatively, this indication can be based on the decision accumulator $p_m(k)$ which is dependent on a time-averaged measure of mismatch $\tilde{r}_m(k)$ as provided above.

The time-frequency input signal $X_m(k)$ is applied to the tonal signal prediction filter $\hat{B}^{(m)}(k)$ 303 in order to provide a predicted time-frequency input signal $\hat{X}_m(k)$, which is subtracted (cf. adder 304) from the time-frequency input signal $X_m(k)$ to provide a first modified time-frequency input audio signal $E_m(k)$, which is used together with the time-frequency input signal $X_m(k)$ to continuously further adapt (cf. adaptation block 305) the predictive filter coefficients $\hat{B}_1^{(m)}(k)$, $\hat{B}_2^{(m)}(k)$ of the tonal signal prediction filter $\hat{B}^{(m)}(k)$ 303. On the other hand, the time-frequency processed audio signal $Y_m(k)$, upon which the output signal provided to the loudspeaker 322 is based, is applied to a further filter $\hat{B}^{(m)}(k)$ 308 supplied with the same filter coefficients $\hat{B}_1^{(m)}(k)$, $\hat{B}_2^{(m)}(k)$ as the tonal signal prediction filter $\hat{B}^{(m)}(k)$ 303 to produce a predicted time-frequency processed audio signal $\hat{Y}_m(k)$. This predicted time-frequency processed audio signal $\hat{Y}_m(k)$ is subtracted (cf. adder 309) from the time-frequency processed audio signal $Y_m(k)$ to provide a modified time-frequency processed audio signal.

The feedback estimation filter $\hat{H}^{(m)}(k)$ 313 is then adapted (e.g. using a gradient descent scheme, such as for instance an NLMS technique; cf. adaptation block 310) based on the modified time-frequency processed audio signal and/or on the time-frequency processed audio signal dependent on the measure of mismatch, and further based on the first modified time-frequency input audio signal and/or on the time-frequency input audio signal dependent on the measure of mismatch. The dependency of the filter adaptation on the measure of mismatch, can take on a variety of different forms. For instance weight factors $w_1$, $w_2$, $w_3$ and $w_4$ (cf. selector and mixer/weighting blocks 311 & 312) can be applied to the modified time-frequency processed audio signal, the time-frequency processed audio signal, the modified time-frequency input audio signal, and the time-frequency input audio signal, respectively, wherein the weight factors $w_1$, $w_2$, $w_3$ and $w_4$ (-> mixing) are dependent on the determined measure of mismatch $P_m(k)$ (or decision accumulator $p_m(k)$), i.e. the at least one indication. In particular $w_1=1$, $w_2=0$, $w_3=1$ and $w_4=0$ if the measure of mismatch $P_m(k)$ (or decision accumulator $p_m(k)$) is above a pre-set threshold, and $w_1=0$, $w_2=1$, $w_3=0$ and $w_4=1$ if the measure of mismatch $P_m(k)$ (or decision accumulator $p_m(k)$) is below the pre-set threshold, in which case a "hard decision" (i.e. true or false->selection) is made regarding whether a tonal signal component is present in the in the time-frequency input signal $X_m(k)$. Then if a tonal signal component is present, the modified time-frequency processed audio signal is applied to the feedback estimation filter $\hat{H}^{(m)}(k)$ 313 the output of which is subtracted (cf. adder 314) from the first modified time-frequency input audio signal, the resulting difference signal being used together with the modified time-frequency processed audio signal to adapt (cf. adaptation block 310) the coefficients of the feedback estimation filter $\hat{H}^{(m)}(k)$ 313. If however no tonal signal component is present, the time-frequency processed audio signal is applied to the feedback estimation filter $\hat{H}^{(m)}(k)$ 313 the output of which is subtracted (cf. adder 314) from the time-frequency input audio signal, the resulting difference signal being used together with the time-frequency processed audio signal to adapt (cf. adaptation block 310) the coefficients of the feedback estimation filter $\hat{H}^{(m)}(k)$ 313.

The actual feedback cancellation takes place by applying the time-frequency processed audio signal $Y_m(k)$ to a further feedback estimation filter $\hat{H}^{(m)}(k)$ 315 having the same filter coefficients that are determined (e.g. by means of an NLMS algorithm) for the feedback estimation filter 313, the output of which is the estimated feedback signal, which is then subtracted (cf. adder 316) from the time-frequency input signal $X_m(k)$ to provide a second modified time-frequency input signal, which is essentially free of feedback. The second modified time-frequency input signal is then applied to a frequency and/or input level dependent amplification according to a gain model 317 to produce the time-frequency processed audio signal $Y_m(k)$.

Optionally, a noise signal (cf. noise generator 318) can be added to the time-frequency processed signal in dependence of the measure of mismatch (i.e. the at least one indication), wherein no noise signal is generated or added (cf. adder 319) if the measure of mismatch $P_m(k)$ (or decision accumulator $p_m(k)$) is below a pre-set threshold. Furthermore, the noise signal may be dependent on the level of the second modified band-limited input signal.

The plurality K of time-frequency processed audio signals $Y_m(k)$ is then applied to a synthesis filter bank 320, the output of which is a time-domain processed audio signal $y_n$, which is fed into an output transducer (e.g. loudspeaker) 322 which converts the audio signal into a bearable sound.

The invention claimed is:

1. A method for providing at least one indication regarding whether an input signal contains a tonal signal component, the method comprising the steps of:

decomposing the input signal into a plurality of band-limited input signals;

for each of one or more of the plurality of band-limited input signals:

estimating parameters of a parametric tonal signal model adapted to model and predict a tonal-only signal component in a selected one of the one or more of the plurality of band-limited input signals;

synthesizing based on the estimated parameters a corresponding predicted band-limited input signal; and determining a measure of mismatch between the selected band-limited input signal and the corresponding predicted band-limited input signal;

and providing the at least one indication based on the measure of mismatch determined for at least one of the one or more of the plurality of band-limited input signals.

2. The method of claim 1, wherein the parametric tonal signal model is adapted to model the tonal-only signal component consisting of a predefined number of sinusoids.

3. The method of claim 2, wherein the parameters of the parametric tonal signal model are estimated by means of linear prediction coefficients constrained such that a one-to-one relationship exists between the parameters of the parametric tonal signal model and the linear prediction coefficients.

4. The method of claim 3, wherein the linear prediction coefficients $\hat{B}_1, \ldots, \hat{B}_I$ are constrained as follows:

$$\text{for } I = 1: |\hat{B}_1| = 1;$$

$$\text{for } I = 2: |\hat{B}_1| \le 2 \text{ and } \hat{B}_2 = -\frac{\hat{B}_1^2}{|\hat{B}_1|^2};$$

$$\text{for } I = 3: |\hat{B}_1| \le 3, |\hat{B}_2| \le 3 \text{ and } \hat{B}_3 = -\frac{\hat{B}_1\hat{B}_2}{|\hat{B}_1\hat{B}_2|};$$

$$\text{for } I = 4: |\hat{B}_1| \le 4, |\hat{B}_2| \le 6, \hat{B}_4 = -\frac{\hat{B}_2^2}{|\hat{B}_2|^2} \text{ and } \hat{B}_3 = -\hat{B}_1^*\hat{B}_4,$$

wherein I is the predefined number of sinusoids of the parametric tonal signal model.

5. The method of claim 2, wherein the measure of mismatch is given by an error-to-signal energy ratio, such as a ratio of a squared magnitude of a difference between the selected band-limited input signal and the corresponding predicted band-limited input signal and a squared magnitude of the selected band-limited input signal.

6. A method for operating a hearing device, in particular a hearing aid to be worn at an ear of a user, comprising the steps of:

receiving an input audio signal;

providing at least one indication regarding whether the input audio signal contains a tonal signal component according to the method of one of claims 1 to 5;

applying at least one of the following signal processing schemes to the input audio signal:

feedback cancelling;

noise cancelling;

frequency transposition or frequency compression;

frequency and/or input level dependent amplification according to a gain model;

sound classification;

beamforming;

occlusion cancelling, dependent on the at least one indication to provide a processed audio signal and/or identify at least one sound class representative of the input audio signal; and outputting an output audio signal based on the processed audio signal and/or in dependence of the at least one sound class.

7. The method of claim 6, wherein feedback cancelling is applied to one or more of the plurality of band-limited input audio signals and comprises the following steps for each of said one or more of the plurality of band-limited input audio signals:

subtracting the predicted band-limited input audio signal from the band-limited input audio signal to produce a first modified band-limited input audio signal;

synthesizing based on the same estimated parameters as used to synthesize the predicted band-limited input audio signal a predicted band-limited processed audio signal;

subtracting the predicted band-limited processed signal from the corresponding band-limited processed audio signal to produce a modified band-limited processed audio signal;

determining filter coefficients of a feedback estimation filter based on the modified band-limited processed audio signal and/or on the band-limited processed audio signal dependent on the at least one indication, and further based on the first modified band-limited input audio signal and/or the band-limited input audio signal dependent on the at least one indication;

applying the band-limited processed audio signal to the feedback estimation filter to produce an estimated band-limited feedback signal;

subtracting the estimated band-limited feedback signal from the band-limited input signal.

8. The method of claim 7, wherein feedback cancelling further comprises the steps of:

generating a noise signal; and adding the noise signal to the band-limited processed signal, in dependence of the at least one indication.

9. The method of claim 7 or 8, wherein determining the filter coefficients of the feedback estimation filter is based on the modified band-limited processed audio signal weighted by a first weight factor $w_1$, the band-limited processed audio signal weighted by a second weight factor $w_2$, the first modified band-limited input audio signal weighted by a third weight factor $w_3$, and the band-limited input audio signal weighted by a fourth weight factor $w_4$, the weight factors $w_1$, $w_2$, $w_3$ and $w_4$ being dependent on the at least one indication.

10. A hearing device comprising:

an input transducer structured and configured to receive an input audio signal;

a signal processing unit structured and configured to process the input audio signal and to produce a processed audio signal; and an output transducer structured and configured to output an output audio signal based on the processed audio signal, wherein the signal processing unit comprises:

an analysis filter bank structured and configured to decompose the input audio signal into a plurality of band-limited input audio signals;

an amplification unit structured and configured to apply a frequency and/or input level dependent amplification according to a gain model to the plurality of band-limited input audio signals to produce a plurality of band-limited processed audio signals;

an synthesis filter bank structured and configured to combine or compose the plurality of band-limited processed audio signals into the processed audio signal;

a feedback canceller; and a tonal signal detector operationally connected to the feedback canceller, wherein the tonal signal detector comprises a tonal signal prediction filter with an input, to which a selected one of the band-limited input audio signal is provided, and an output providing a predicted band-limited input audio signal, the tonal signal detector being further structured and configured to determine a measure of mismatch between the band-limited input audio signal and the predicted band-limited input audio signal, and wherein the feedback canceller comprises:

a further filter for applying the same filter coefficients as the tonal signal prediction filter to produce a predicted band-limited processed audio signal;

a computation unit configured to determine further filter coefficients based on a difference between the band-limited processed audio signal and the predicted band-limited processed audio signal and/or on the band-limited processed audio signal dependent on the measure of mismatch, and further based on a difference between the input audio signal and the predicted input signal and/or on the band-limited input audio signal dependent on the measure of mismatch;

a feedback estimation filter operationally connected to the computation unit and adapted to filter with the further filter coefficients the band-limited processed audio signal to provide an estimated band-limited feedback signal, and wherein an input of the amplification unit is connected to an output of a subtraction unit adapted to subtract the estimated band-limited feedback signal from the band-limited input audio signal.

* * * * *